US009141066B2

(12) United States Patent
Fukatsu et al.

(10) Patent No.: US 9,141,066 B2
(45) Date of Patent: Sep. 22, 2015

(54) SHEET PROCESSING APPARATUS FOR APPLYING POST PROCESS TO SHEET

(71) Applicant: CANON KABUSHIKI KAISHA, Tokyo (JP)

(72) Inventors: Yasuo Fukatsu, Abiko (JP); Taishi Tomii, Matsudo (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 14/445,269

(22) Filed: Jul. 29, 2014

(65) Prior Publication Data

US 2015/0037080 A1 Feb. 5, 2015

(30) Foreign Application Priority Data

Aug. 1, 2013 (JP) ..... 2013-160375

(51) Int. Cl.
*G03G 15/00* (2006.01)
*B65H 37/00* (2006.01)

(52) U.S. Cl.
CPC ..... *G03G 15/6582* (2013.01)

(58) Field of Classification Search
CPC ..... G03G 15/00; G03G 15/6582; B65H 37/00
USPC ..... 399/361, 381, 394, 395, 407, 408, 410; 271/226–255; 347/104
See application file for complete search history.

(56) References Cited

U.S. PATENT DOCUMENTS

| | | | | |
|---|---|---|---|---|
| 6,019,365 | A * | 2/2000 | Matsumura | 271/227 |
| 8,066,279 | B2 | 11/2011 | Ishikawa et al. | |
| 8,256,767 | B2 * | 9/2012 | Williams et al. | 271/228 |
| 8,919,770 | B2 * | 12/2014 | Mattern et al. | 271/227 |
| 2004/0094891 | A1 * | 5/2004 | Trovinger et al. | 271/227 |
| 2006/0177253 | A1 * | 8/2006 | Aiko | 399/394 |
| 2008/0308987 | A1 * | 12/2008 | Iguchi et al. | 270/58.03 |
| 2009/0033028 | A1 * | 2/2009 | Yahata et al. | 271/259 |
| 2012/0025457 | A1 * | 2/2012 | Inoue | 271/227 |
| 2012/0262765 | A1 * | 10/2012 | Saito | 358/488 |
| 2013/0036886 | A1 * | 2/2013 | Kato et al. | 83/73 |

* cited by examiner

*Primary Examiner* — Nguyen Ha
(74) *Attorney, Agent, or Firm* — Rossi, Kimms & McDowell LLP

(57) ABSTRACT

A sheet processing apparatus that is capable of setting a sheet conveyance distance from a first detection to a second detection according to a sheet length. A sensor unit on which first and second sensors are arranged in a sheet width direction to detect a side end of a sheet in the sheet width direction. A moving unit moves the sensor unit in the sheet width direction. A setting unit sets up a second movement speed based on the sheet length obtained. A control unit controls the moving unit so as to move the sensor unit at a first movement speed, and so as to move the sensor unit at the second movement speed until the end section is detected by the second sensor after the side end is detected by the first sensor.

15 Claims, 13 Drawing Sheets

SHEET PROCESSING APPARATUS FOR APPLYING POST PROCESS TO SHEET

BACKGROUND OF THE INVENTION

1. Field of the Invention

The present invention relates to a sheet processing apparatus that applies a post process to a sheet.

2. Description of the Related Art

There are known conventional sheet processing apparatuses each of which applies a post process like a punching process to a sheet on which an image has been formed. Such a sheet processing apparatus detects misalignment of a sheet in a sheet width direction that is perpendicular to a sheet conveyance direction (referred to as "lateral misalignment", hereafter), and corrects the lateral misalignment in order to increase accuracy of a hole position of a punching process.

There is a known method that moves an optical sensor in the sheet width direction, and obtains an amount of lateral misalignment of a conveyed sheet based on the timing at which the optical sensor detects the lateral end portion (side end) of the sheet.

However, when the sheet is skew, an error difference may occur between the amount of the lateral misalignment at the detected side end and the amount of the lateral misalignment at a portion where a punch hole will be formed (for example, a sheet rear end). Accordingly, it is necessary to obtain correctly the amount of the lateral misalignment in the sheet rear end in consideration of the skew amount of the sheet in order to increase accuracy of the punching hole position.

Incidentally, there is a known apparatus that efficiently detects a sheet side end by moving a sensor unit that consists of a plurality of photo sensors in a sheet width direction during a sheet conveyance (see U.S. Pat. No. 8,066,279).

As shown in FIG. 13, this kind of apparatus detects a sheet side end with a plurality of sensors 1104*a* through 1104*c* arranged on a lateral position sensor unit 1105 in a sheet width direction, and can calculate a skew amount and a lateral misalignment. That is, the lateral position sensor unit 1105 is moved in the sheet width direction during a sheet conveyance, and the lateral position sensor 1104*a* detects a side end at the first time. Then, the lateral position sensor 1104*b* detects the side end at the second time after the lateral position sensor unit 1105 is further moved. Then, the skew amount of the sheet etc. are calculated based on the two detection results.

Like the above-mentioned conventional apparatus, when calculating the skew amount of a sheet using a plurality of sensors, proportional calculation is performed using two sheet-side-end detection results. Accordingly, the sheet conveyance distance from the first detection to the second detection participates in calculation.

However, when the second detection timing is too early, the distance from the position of the second detection to the sheet rear end in the sheet conveyance direction becomes long, and the sheet conveyance distance from the first detection to the second detection becomes short. In that case, an error becomes large in the skew amount calculated using the proportional calculation.

On the other hand, the sensor that detects at the second time needs to reach the sheet side end before the sheet rear end passes the sensor position in order to detect the side end certainly at the second time. In order to correspond to all sheet sizes, the interval between the sensors and the moving velocity of the sensor unit have to be set with a margin so that the side end can be detected at the second time even in a sheet with the shortest sheet length among assumed sheets. However, such a uniform setting must shorten the sheet conveyance distance between the first detection and the second detection.

When the calculation accuracy of the skew amount decreases, an accuracy of a process using the skew amount (a lateral misalignment correction, for example) decreases, which decreases accuracies of a hole position on a sheet etc.

SUMMARY OF THE INVENTION

The present invention provides a sheet processing apparatus that is capable of setting a sheet conveyance distance from the first detection to the second detection according to a sheet length when detecting a sheet end in the width direction with two sensors.

Accordingly, a first aspect of the present invention provides a sheet processing apparatus comprising a conveyance unit configured to convey a sheet, a sensor unit configured to have a plurality of sensors that are arranged in a sheet width direction that intersects perpendicularly with a sheet conveyance direction, and that detect a side end of a sheet in the sheet width direction, a moving unit configured to move the sensor unit in the sheet width direction, a control unit configured to control the moving unit so as to move the sensor unit at a first movement speed during conveyance of the sheet by the conveyance unit, and so as to move the sensor unit at a second movement speed after the side end of the sheet is detected by a first sensor among the plurality of sensors so that the side end of the sheet is detected by a second sensor among the plurality of sensors, an obtaining unit configured to obtain a sheet length of the sheet in the sheet conveyance direction, and a setting unit configured to set up the second movement speed based on the sheet length obtained by the obtaining unit, wherein the control unit controls the moving unit so as to move the sensor unit at the second movement speed set up by the setting unit until the side end of the sheet is detected by the second sensor after the side end of the sheet is detected by the first sensor.

Accordingly, a second aspect of the present invention provides a sheet processing apparatus comprising a conveyance unit configured to convey a sheet, a sensor unit configured to have three or more sensors that are arranged in a sheet width direction that intersects perpendicularly with a sheet conveyance direction, and that detect a side end of a sheet in the sheet width direction, a moving unit configured to move the sensor unit in the sheet width direction, a control unit configured to control the moving unit so as to move the sensor unit during conveyance of the sheet by the conveyance unit so that the side end of the sheet is detected by a first sensor among the plurality of sensors and then the side end of the sheet is detected by a second sensor selected from among the plurality of sensors, an obtaining unit configured to obtain a sheet length of the sheet in the sheet conveyance direction, and a selection unit configured to select a sensor that will be used as the second sensor from among the plurality of sensors other than the first sensor corresponding to the sheet length obtained by the obtaining unit.

According to the present invention, a sheet conveyance distance from the first detection to the second detection can be set according to a sheet length when detecting a sheet end in the width direction with two sensors.

Further features of the present invention will become apparent from the following description of exemplary embodiments with reference to the attached drawings.

BRIEF DESCRIPTION OF THE DRAWINGS

FIG. 5B is a view showing a relation between a sheet and the lateral position sensor shown in FIG. 4 when the lateral position sensor turns OFF from ON.

DESCRIPTION OF THE EMBODIMENTS

Hereafter, embodiments according to the present invention will be described in detail with reference to the drawings.

Figure 1:
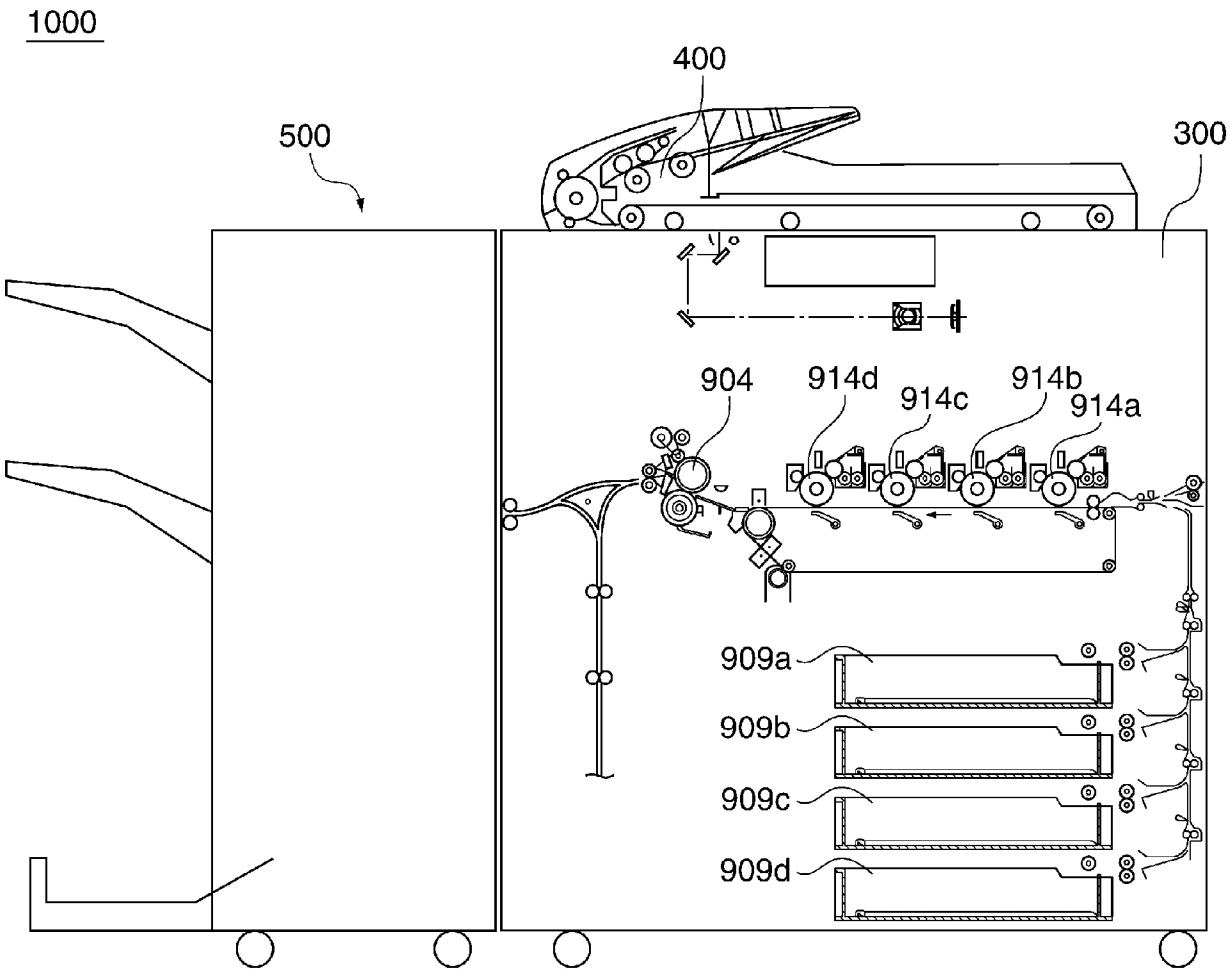
FIG. 1 is a sectional view showing an image forming system including a sheet processing apparatus according to a first embodiment of the present invention.

FIG. 1 is a sectional view showing an image forming system including a sheet processing apparatus according to a first embodiment of the present invention. As shown in FIG. 1, this image forming system 1000 is provided with an image forming apparatus 300, an automatic document feeder 400, and the sheet processing apparatus 500. Although the sheet processing apparatus 500 is connected with the image forming apparatus 300 in this embodiment, it may be united with the image forming apparatus 300.

The image forming apparatus 300 is provided with cassettes 909*a*, 900*b*, 900*c*, and 909*d* that store various sheets (paper sheets). Yellow, magenta, cyan, and black toner images formed on respective photosensitive drums 914*a*, 914*b*, 914*c*, and 914*d* are transferred to a sheet fed from one of these cassettes 909*a*, 900*b*, 900*c*, and 909*d*. The sheet to which the toner images have been transferred is conveyed to a fixing unit 904, and the toner images are fixed by the fixing unit 904. Then, the sheet is ejected to the sheet processing apparatus 500.

Figure 2:
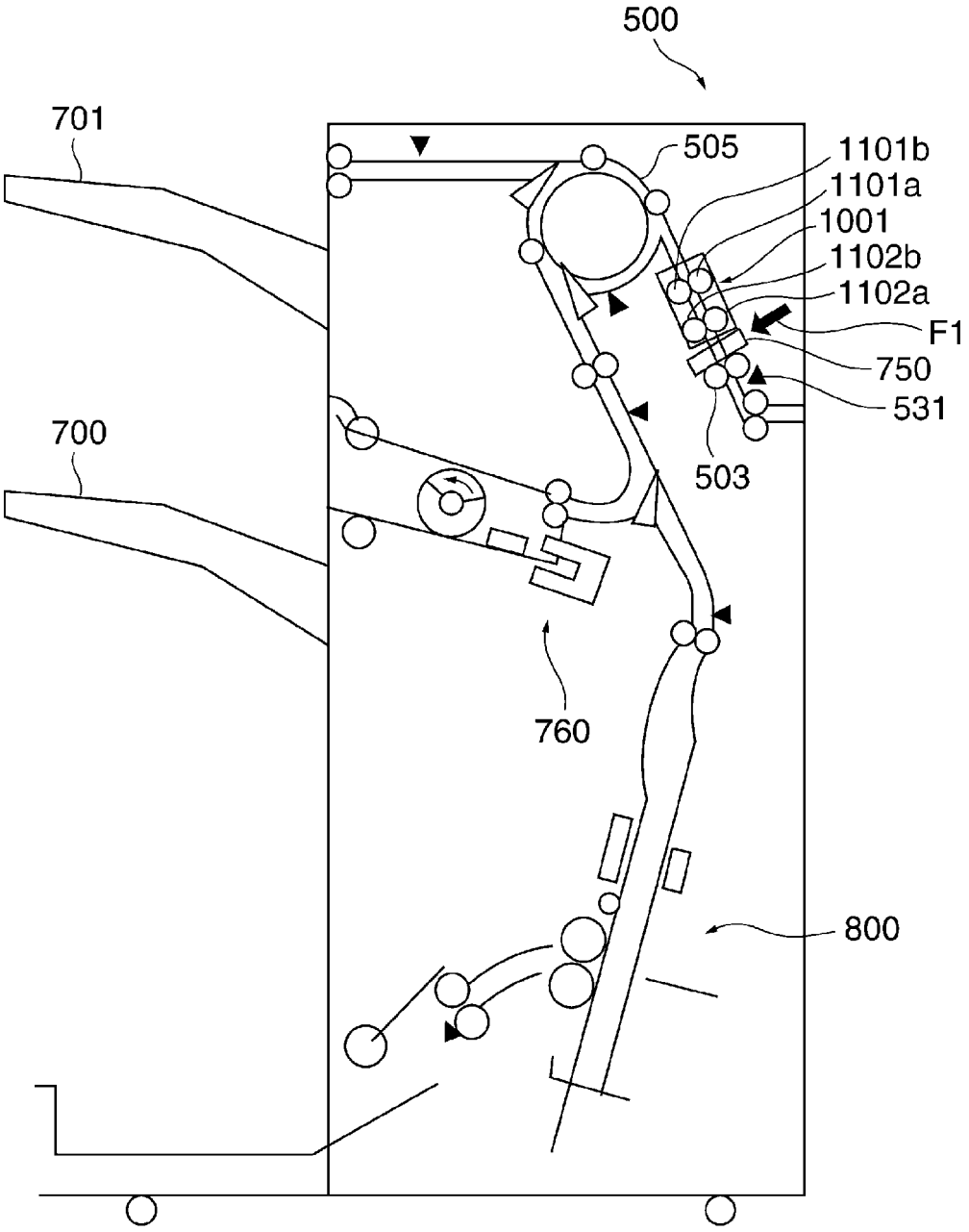
FIG. 2 is a sectional view showing the sheet processing apparatus shown in FIG. 1.

FIG. 2 is a sectional view showing the sheet processing apparatus 500.

The sheet processing apparatus 500 takes in the sheet ejected from the image forming apparatus 300. The sheet processing apparatus 500 can apply an adjusting/bundling process, a sorting process, and a non-sorting process to taken-in sheets as post-processes. Moreover, the sheet processing apparatus 500 can perform a staple process (a binding process) that staples a rear end side of a sheet bundle, a punching process that makes punch holes in the rear end side of sheets, and a bookbinding process that folds a sheet bundle in two and binds a book, etc. as the post-processes. Accordingly, the sheet processing apparatus 500 is provided with a punching unit 750 that performs the punching process, a staple unit 760 that performs the staple process, and a bookbinding unit 800 that performs the bookbinding process.

The sheet processing apparatus 500 is provided with an entrance sensor 531 for detecting a sheet carried in near a sheet carry-in port. A lateral position shift unit 1001 is provided between a conveying roller pair 503 and a buffer roller 505. The lateral position shift unit 1001 has a function of a conveyance unit that conveys a sheet while shifting the sheet in a width direction in a shift sorting mode for offsetting and ejecting a sheet or a punch mode for making punch holes on a sheet. The lateral position shift unit 1001 is provided with conveying rollers 1101*a* and 1102*a* and driven rollers 1101*b* and 1102*b*.

Moreover, the sheet processing apparatus 500 is provided with a tray 700 on which sheets processed normally are stacked and a proof tray 701 on which sheets that are determined abnormal are stacked.

The punching unit 750 will be described with reference to FIG. 3A through FIG. 3C. The punching unit 750 is a device for forming holes to a sheet rear end.

Figure 3A:
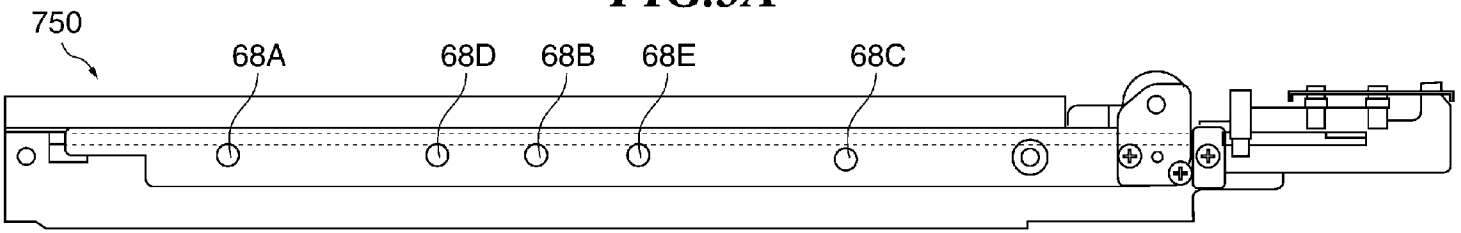
FIG. 3A is a view showing a punching unit shown in FIG. 2 viewed in a direction of an arrow F1 in FIG. 2.

FIG. 3A is a view showing the punching unit 750 viewed in a direction of an arrow F1 in FIG. 2. FIG. 3B is a view showing the punching unit 750 viewed from an upstream side in the sheet conveyance direction. FIG. 3C is a sectional view showing the punching unit 750 along a cam member. The left side and the right side in FIG. 3A, FIG. 3B, and FIG. 3C correspond to the near side and the back side in FIG. 2, respectively.

Figure 3B:
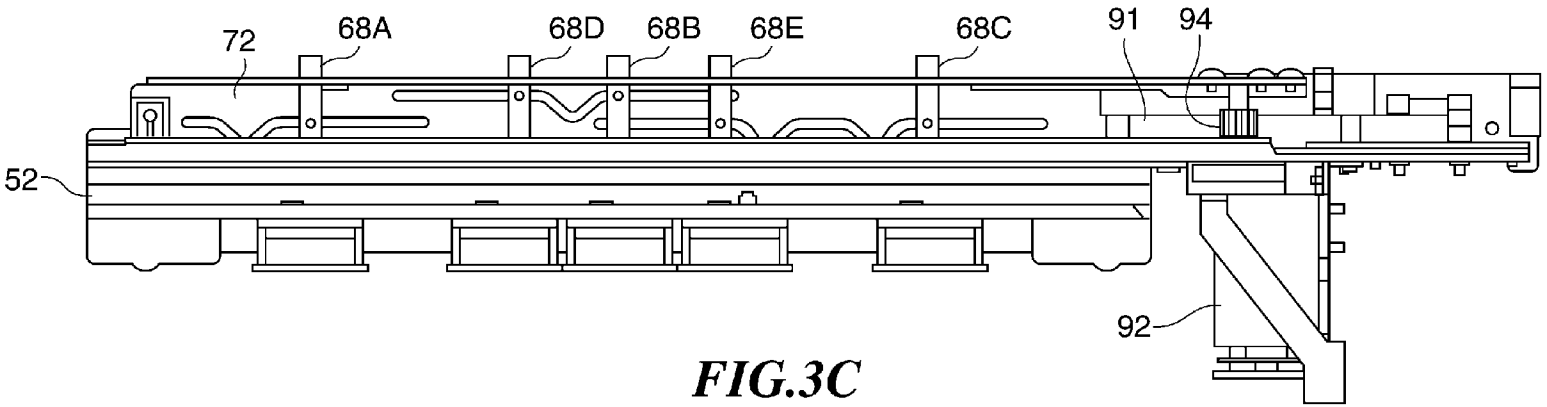
FIG. 3B is a view showing the punching unit shown in FIG. 2 viewed from an upstream side in a sheet conveyance direction.

As shown in FIG. 3B, the punching unit 750 is provided with a cam member 72, and a rack 91 is formed in a right edge section (an edge section at the back side) of the cam member 72. A pinion 94 rotated by a cam member drive motor 92 mounted on a movable frame 52 is meshed with the rack 91. When the cam member drive motor 92 operates, the cam member 72 moves in the right-and-left direction.

Figure 3C:
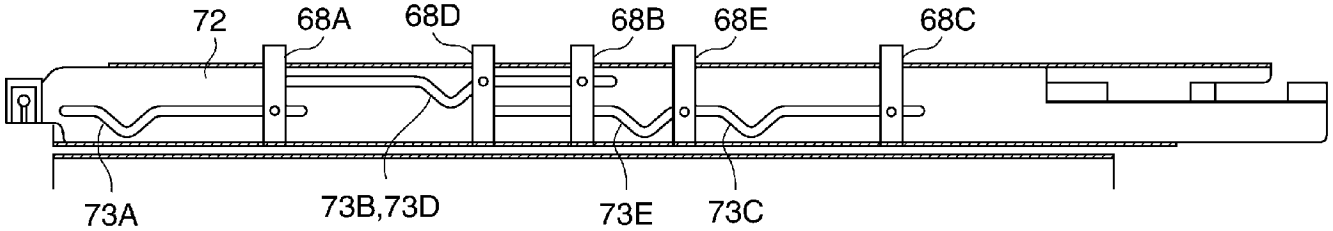
FIG. 3C is a sectional view showing the punching unit shown in FIG. 2 along a cam member.

As shown in FIG. 3C, cam grooves 73A, 73B (73D), 73E, and 73C are formed in the cam member 72 in this order from the left side (the near side). Moreover, punches 68A, 68B, and 68C for three holes and punches 68D and 68E for two holes are provided.

Figure 4:
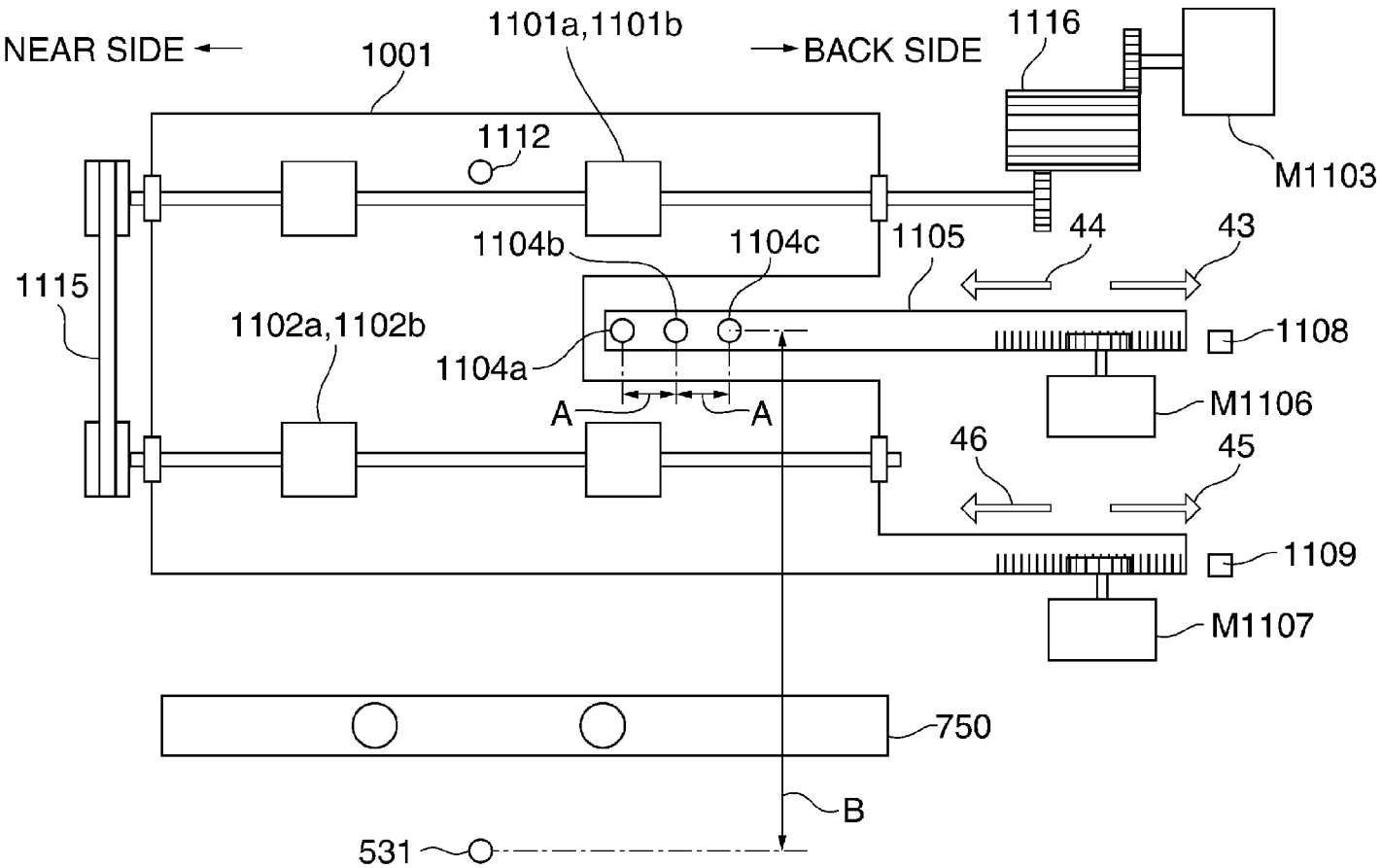
FIG. 4 is a schematic view showing a lateral position shift unit and the punching unit shown in FIG. 2.

FIG. 4 is a schematic view showing the lateral position shift unit 1001 and the punching unit 750 of the sheet processing apparatus 500. The left side and the right side in FIG. 4 correspond to the near side and the back side in FIG. 2, respectively. The upper side in FIG. 4 corresponds to a downstream side of the sheet conveyance direction. The lateral position shift unit 1001 is provided with conveying rollers 1101*a*, 1102*a* and driven rollers 1101*b*, 1102*b*, and is movable in the right-and-left direction in FIG. 4 as a whole.

A conveyance motor M1103 gives drive power to conveying rollers 1101*a*, 1102*a* through a gear 1116 and a timing belt 1115. And the conveying rollers 1101*a*, 1102*a* and driven rollers 1101*b*, 1102*b* collaborate to convey a sheet.

Hereafter, the misalignment in the sheet width direction that intersects perpendicularly with the sheet conveyance direction is referred to as "lateral misalignment". Lateral misalignment and skew of a conveyed sheet are obtained based on detection results of a lateral end (side end) of the sheet detected by a plurality of lateral position sensors 1104*a* through 1104*c* of a lateral position sensor unit 1105.

First, the three lateral position sensors 1104*a*, 1104*b*, and 1104*c* are arranged on the lateral position sensor unit (referred to as a "sensor unit", hereafter) 1105 in the sheet width direction. The lateral position sensors 1104*a*, 1104*b*, and 1104*c* are arranged at equal intervals A (about 10 mm).

The configurations of the lateral position sensors 1104*a*, 1104*b*, and 1104*c* are identical. Each sensor consists of a light emitting element and a photo detector, and is implemented to the sensor unit 1105. The sensor unit 1105 is driven in the right-and-left direction by a lateral-position-sensor-moving motor (a moving unit) M1106 as shown by the arrows 44 and 43 in FIG. 4. The lateral position sensors 1104*a*, 1104*b*, and 1104*c* move integrally with the sensor unit 1105.

The lateral-position-sensor-moving motor M1106 is a stepping motor. And the moving distance of the sensor unit 1105, i.e., the moving distance of the lateral position sensors 1104*a*, 1104*b*, and 1104*c* can be found from the number of driving pulses applied to the stepping motor. A home position (an HP, a standby position) of the sensor unit 1105 is detected by a lateral position HP sensor 1108.

Figure 5A:
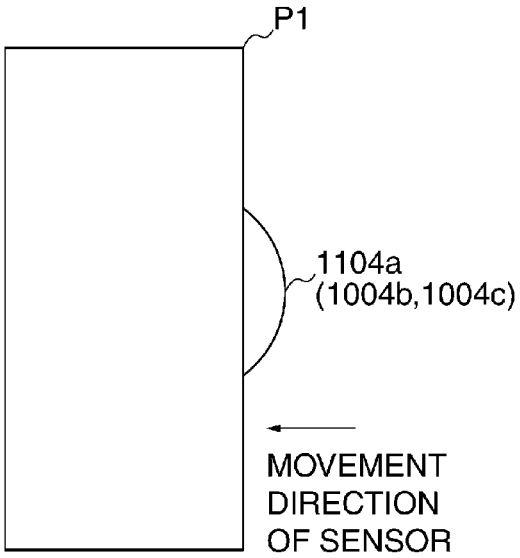
FIG. 5A is a view showing a relation between a sheet and a lateral position sensor shown in FIG. 4 when the lateral position sensor turns ON from OFF.
Figure 5B:
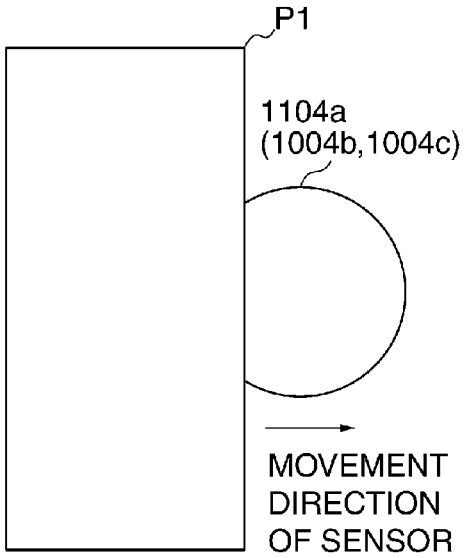

FIG. 5A is a view showing the relation between a sheet (shown as P1) and the lateral position sensor 1104*a* (1104*b*, 1104*c*), when the lateral position sensor 1104*a* (1104*b*, 1104*c*) turns ON from OFF. FIG. 5B is a view showing the relation between the sheet and the lateral position sensor 1104*a* (1104*b*, 1104*c*), when the lateral position sensor 1104*a* (1104*b*, 1104*c*) turns OFF from ON. Since hysteresis is given to a receiver circuit of the lateral position sensor 1104*a* (1104*b*, 1104*c*), the position at which the lateral position sensor 1104 detects a side end when the sensor turns ON from OFF differs from the position at which the sensor detects the side end when the sensor turns OFF from ON, as shown in FIG. 5A and FIG. 5B.

Moreover, as shown in FIG. 4, a lateral position shift motor M1107 as a shifting unit for driving and shifting the lateral position shift unit 1001 in the right-and-left direction as shown by arrows 45 and 46 is provided separately from the sensor unit 1105. A home position of the lateral position shift unit 1001 is detected by a shift-unit HP sensor 1109.

A rear end detection sensor 1112 detects a conveyed sheet, and detects that the rear end of the sheet exits from the conveying rollers 1101*a* and 1101*b* in the lateral position shift unit 1001.

Figure 6:
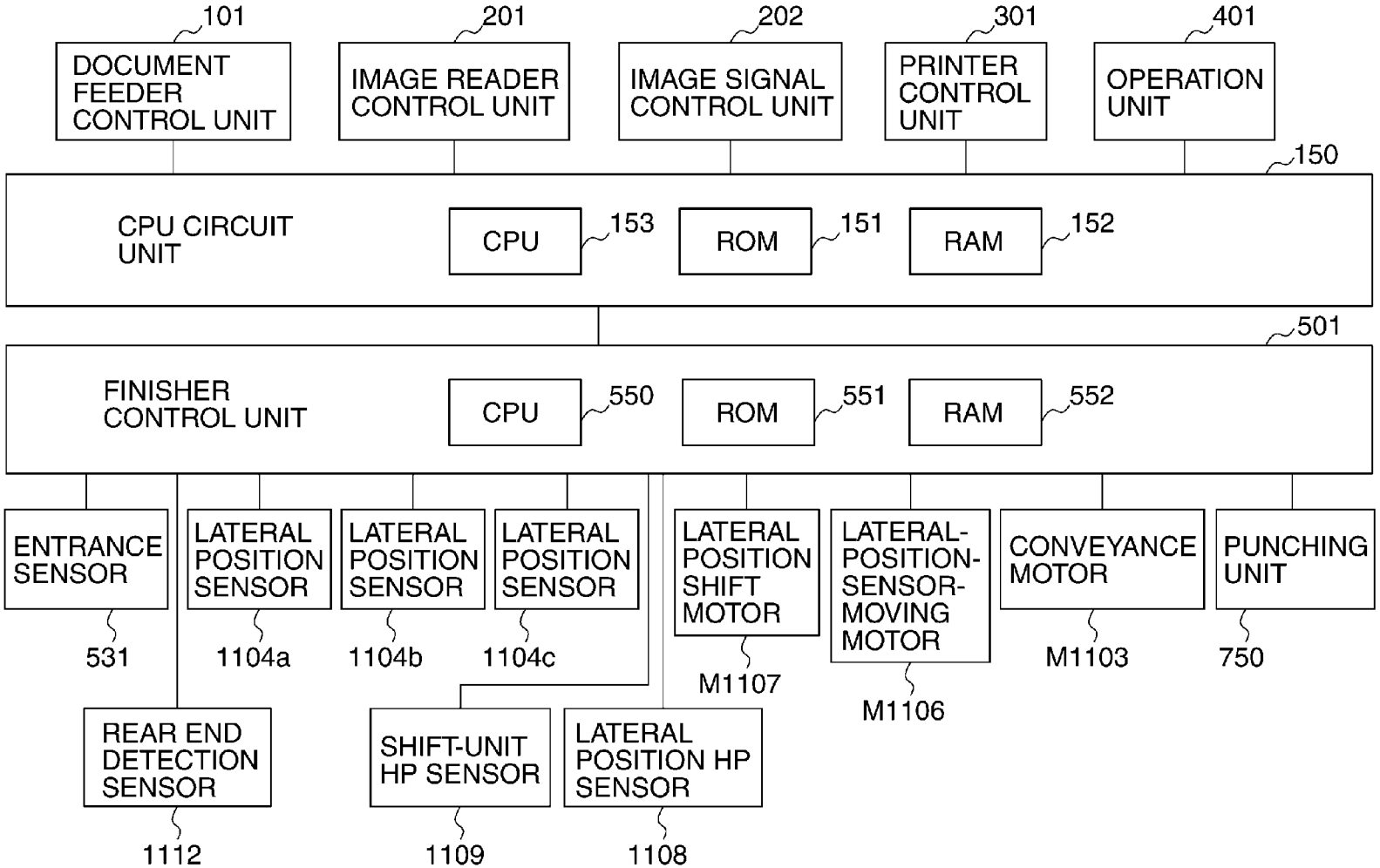
FIG. 6 is a block diagram schematically showing a control system of the image formation system shown in FIG. 1.

FIG. 6 is a block diagram schematically showing a control system of the image formation system 1000.

The image forming apparatus 300 is provided with a CPU circuit section 150. The CPU circuit unit 150 incorporates a CPU 153, a ROM 151, and a RAM 152, and collectively controls the image forming apparatus 300 according to a control program stored in the ROM 151. The RAM 152 stores control data temporarily, and is used as a working area of the arithmetic process accompanying control.

A document feeder control unit 101 controls the automatic document feeder 400 based on instructions from the CPU circuit unit 150. An image reader control unit 201 controls a scanner so as to transfer an analog image signal outputted from the scanner to an image signal control unit 202. The image signal control unit 202 converts the analog image signal into a digital signal, applies various processes to the digital signal, converts the digital signal into a video signal, and outputs it to the printer control unit 301. The printer control unit 301 drives an exposure control unit based on the video signal inputted from the image signal control unit 202. An operation unit 401 receives various operating instructions, transfers the operating instructions to the CPU circuit unit 150, and displays information based on a signal from the CPU circuit unit 150 on a display section.

A finisher control unit 501 is also mounted in the sheet processing apparatus 500. The finisher control unit 501 controls the entire sheet processing apparatus 500 by exchanging information with the CPU circuit unit 150. The finisher control unit 501 may be mounted in the image forming apparatus 300.

The finisher control unit 501 is provided with a CPU 550, a ROM 551, a RAM 552, etc. The finisher control unit 501 communicates with the CPU circuit unit 150 of the image forming apparatus 300 through a communication IC (not shown) to exchange data. The finisher control unit 501 executes various programs stored in the ROM 552 according to instructions from the CPU circuit unit 150, and controls the operations of the sheet processing device 500.

Moreover, the finisher control unit 501 controls the motors M1107, M1106, and M1103 and the punching unit 750 based on the detection results of the entrance sensor 531, the rear end detection sensor 1112, the shift-unit HP sensor 1109, and the lateral position sensors 1104*a*, 1104*b*, and 1104*c*.

A skew-amount calculation control will be described with reference to FIG. 7 through FIG. 9. In the following description, sheets of different sizes may be used. When the sheets of different sizes are called, a sheet Ss is the smallest, a sheet Sm is medium in size, and a sheet SL is the largest.

Figure 7:
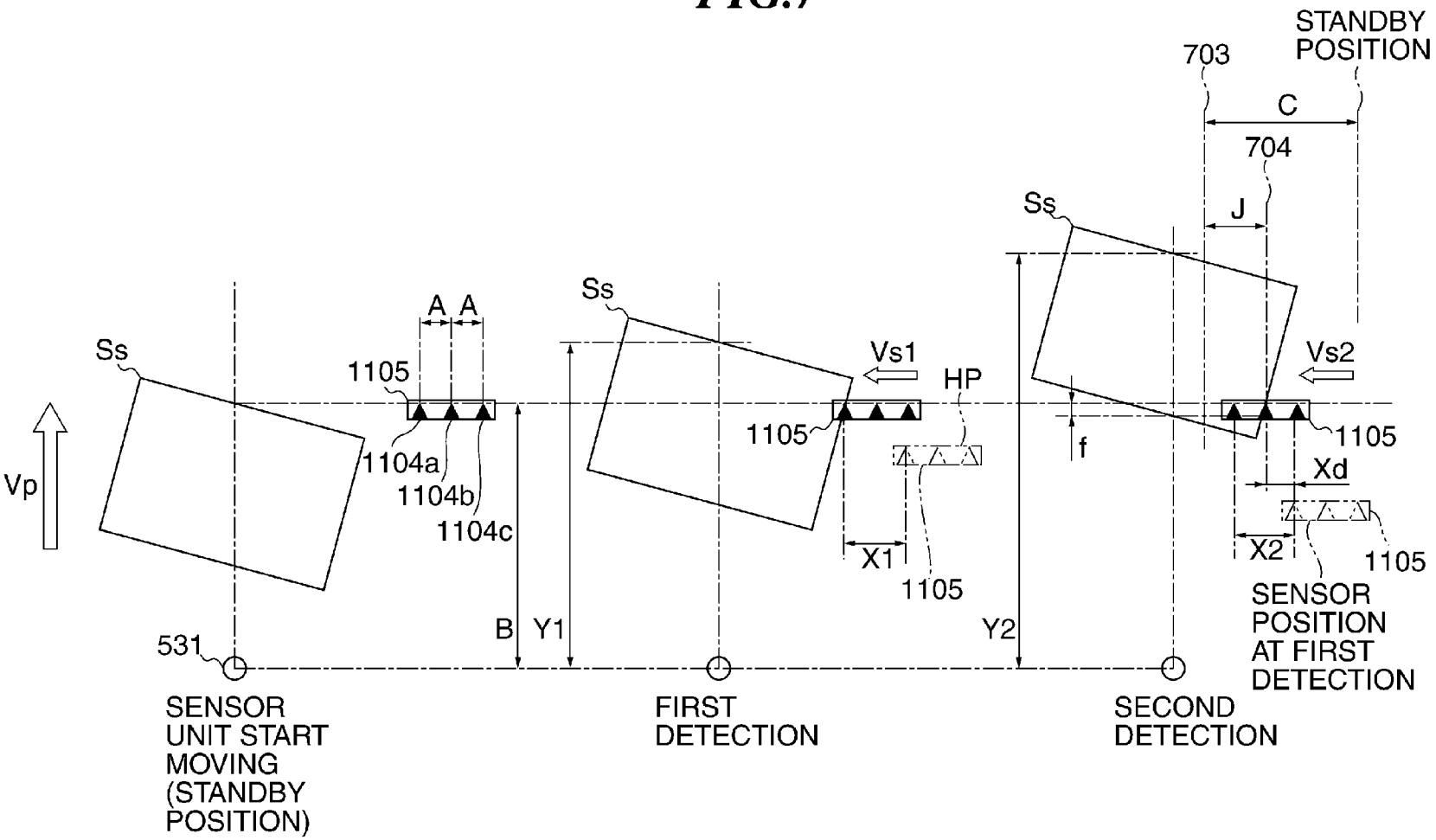
FIG. 7 is a view showing a state where a sensor unit shown in FIG. 4 detects a side end of a sheet twice.

FIG. 7 is a view showing a state where the sensor unit 1105 detects a side end of a sheet twice. It should be noted that FIG. 7 shows the positional relationships between the sheet and the sensor unit 1105 at three timings that are arranged in the lateral direction of the drawing. Moreover, although the positions of the sensor unit 1105 indicated with broken lines are expressed correctly in the width direction, the positions in the conveyance direction are different from actual positions for the purpose of easily looking. FIG. 8 is a flowchart showing the lateral position detection control. FIG. 9 is a timing chart showing the lateral position detection control.

The sensor unit 1105 moves to approach the center of the sheet in the sheet width direction (a forward movement stroke) according to the control by the finisher control unit 501 during conveyance of the sheet by the lateral position shift unit 1001. Then, two lateral position sensors detect a sheet side end in one forward movement stroke for detecting a side end. In a first embodiment, the first sensor that detects first shall be the lateral position sensor 1104*a*, and the second sensor that detects secondly shall be the lateral position sensors 1104*b*. It should be noted that the first sensor may be the lateral position sensor 1104*b* and the second sensor may be the lateral position sensor 1104*c* depending on the misalignment amount of a sheet in the width direction.

When a leading end is detected, a sheet is conveyed at a certain sheet conveyance speed Vp. After the time interval T1 elapses from the timing at which the entrance censor 531 turns ON, the sensor unit 1105 starts moving from the home position. It should be noted that the distance conveyed in the time interval T1 is B shown in FIG. 4 and FIG. 7, and the distance B is equal to the distance from the entrance sensor 531 to lateral position sensors 1104*a*, 1104*b*, and 1104*c* in the conveyance direction. In the forward movement stroke of the sensor unit 1105, the sensor unit 1105 moves at a first movement speed Vs1 until detecting first, while a sheet is conveyed in the sheet conveyance direction. After detecting first, the sensor unit 1105 moves at a second movement speed Vs2 until detecting secondly. The first movement speed Vs1 is a steady value. The second movement speed Vs2 is set after detecting first, and the detail will be mentioned later. The movement speed of the sensor unit 1105 is controlled because the finisher control unit 501 drives the lateral-position-sensor-moving motor M1106.

When the leading end is detected, the sensor unit 1105 is driven by the lateral-position-sensor-moving motor M1106 so as to move at the first movement speed Vs1 from the home position, while a sheet is conveyed in the sheet conveyance direction. Then, the lateral position sensor 1104*a* detects a sheet side end first. Then, the sensor unit 1105 moves at the second movement speed Vs2, and the lateral position sensor 1104*b* detects sheet side end secondly.

As shown in FIG. 7, a sheet conveyance distance between the timing at which the front end of the sheet in the sheet conveyance direction is detected (i.e., the entrance sensor 531 turns ON) and the timing at which the side end of the sheet is detected first is defined as Y1. A sheet conveyance distance after the entrance sensor 531 turns ON until the side end of the sheet is detected secondly is defined as Y2. A moving amount of the sensor unit 1105 from the home position to the position at which the side end of the sheet is detected first is a moving distance X1. A moving amount of the sensor unit 1105 from the position at which the side end of the sheet is detected first to the position at which the side end of the sheet is detected secondly is a moving distance X2. Accordingly, the sensor unit 1105 moves through the moving distance X1 at the first movement speed Vs1, and moves through the moving distance X2 at the second movement speed Vs2.

Moreover, a misalignment value between the first detection position and the second detection position of the side end is defined as Xd. In the first embodiment, since the interval between the lateral position sensors 1104*a* and 1104*b* is A, the misalignment value Xd is obtained by Xd=X2−A. When skew of a sheet is zero, X2 is equal to A because Xd is 0.

Figure 9:
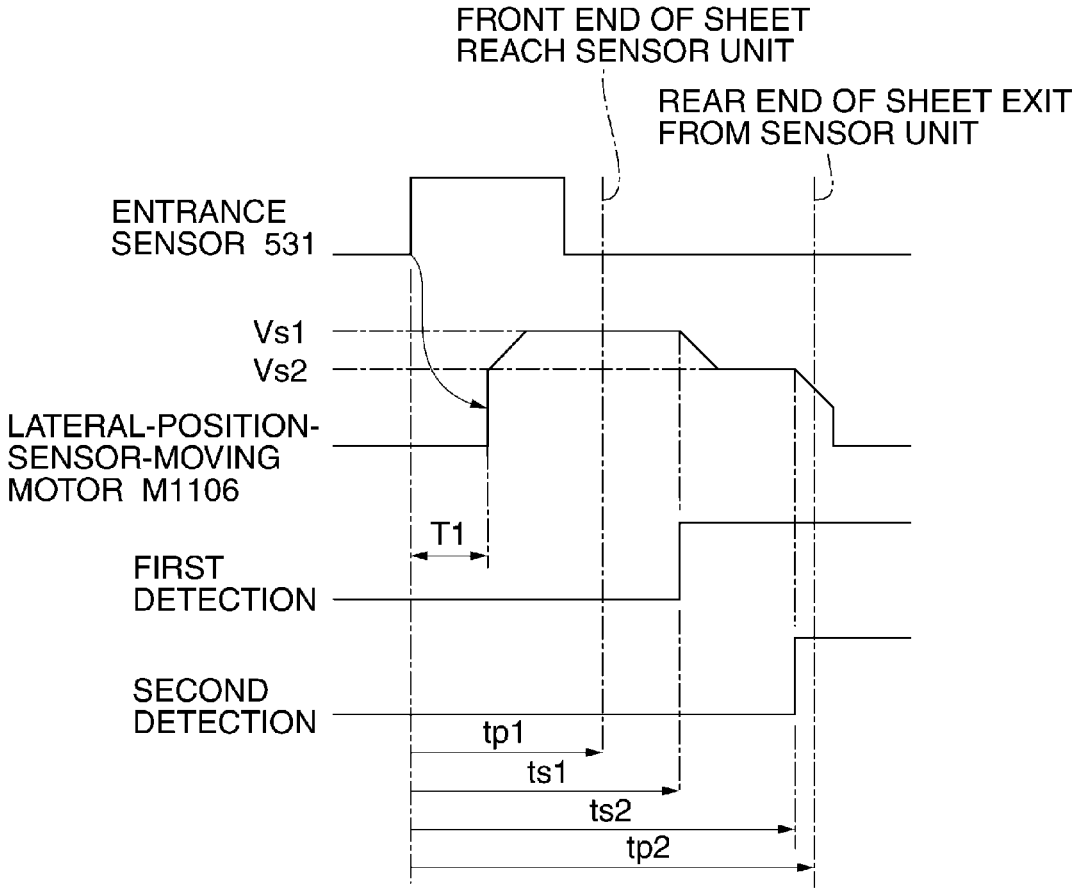
FIG. 9 is a timing chart showing a lateral position detection control of the sheet processing apparatus shown in FIG. 1.

Moreover, time intervals tp1, tp2, ts1, and ts2, which start at a reference timing (a reference point) at which the entrance sensor 531 turns ON, are defined as shown in FIG. 9. The time interval tp1 is the time required until the front end of the sheet arrives at the position of the lateral position sensors 1104*a*, 1104*b*, and 1104*c* of the sensor unit 1105 in the sheet conveyance direction from the reference timing. The time interval tp1 is calculated with the following formula 1.

$$tp1=B/Vp \quad \text{[Formula 1]}$$

The time interval tp2 is the time required until the rear end of the sheet exits from the position of the lateral position sensors 1104*a*, 1104*b*, and 1104*c* in the sheet conveyance direction from the reference timing. The length of the sheet, which is conveyed and is subjected for detecting the side end, in the sheet conveyance direction is a sheet length Ls. The time interval tp2 is calculated with the following formula 2.

$$tp2=(B+Ls)/Vp \quad \text{[Formula 2]}$$

The time interval ts1 is the time required until the side end of the sheet is detected first from the reference timing. The time interval ts1 is calculated with the following formula 3.

$$ts1=T1+X1/Vs1 \quad \text{[Formula 3]}$$

The time interval ts2 is the time required until the side end of the sheet is detected secondly from the reference timing. The time interval ts2 is calculated with the formula: ts2=ts1+X2/Vs2. However, the moving distance X2 is unknown at the time when the side end is detected first, because the side end is not detected secondly at the time. Accordingly, the time interval ts2 is estimated with the following formula 4, assuming that the skew of the sheet is zero (X2=A).

$$ts2=ts1+A/Vs2 \quad \text{[Formula 4]}$$

The skew amount α of the sheet is calculated with the following formula 5.

$$\alpha=Xd/(Y2-Y1) \quad \text{[Formula 5]}$$

The difference (Y2−Y1) is equivalent to the conveyance amount of the sheet that is conveyed until the second sensor detects the sheet side end after the detection by the first sensor.

It should be noted that the distance B, the time interval T1, the sheet conveyance speed Vp, and the first movement speed Vs1 are known, and the finisher control unit 501 grasps them beforehand. The finisher control unit 501 determines the sheet length Ls according to sheet size information sent from the CPU circuit unit 150 of the image forming apparatus 300. The finisher control unit 501 obtains and grasps the moving distances X1 and X2 according to the number of driving pulses for the lateral-position-sensor-moving motor M1106.

In order to certainly detect the side end secondly, the lateral position sensor 1104*b*, which is the second sensor, needs to reach the side end of the sheet before the sheet rear end exits from the position of the lateral position sensors 1104*a*, 1104*b*, and 1104*c* in the sheet conveyance direction.

On the other hand, if too much margin is set so that the side end is detected secondly just after it is detected first, the sheet conveyance distance between two detection timings becomes short. In that case, since the misalignment value Xd and the difference (Y2−Y1) in the formula 5 become small, the calculation accuracy of the skew amount α becomes low.

Then, the sheet conveyance distance between the two detection timings preferably becomes as long a distance as possible on the assumption that the lateral position sensor 1104*b* detects the side end before the sheet rear end exits from the position of the lateral position sensors 1104*a*, 1104*b*, and 1104*c*. That is, it is preferable that the distance f from the position at which the side end is detected secondly to a sheet-rear-end approximation position (estimated position) in the sheet conveyance direction becomes as short a distance as possible.

For that purpose, the second movement speed Vs2 is necessary to be set so that the distance f becomes as short as possible within a limitation that satisfies the condition "ts2<tp2". However, since the skew amount α of the sheet is unknown before detecting the side end secondly, the exact sheet rear end position is unknown actually. Moreover, when deviations of the conveyance speed and the moving speed and other errors are taken into a consideration, it is necessary to detect the side end secondly with some margin in order to prevent a case where the side end cannot detect secondly.

Accordingly, the case where skew is zero is considered as a base, and the second movement speed Vs2 is calculated and is set using a specified margin value Z (predetermined time).

Specifically, the second movement speed Vs2 is determined so that the following formula 6 is materialized. The margin value Z is beforehand determined from an experimental value in consideration of a skew amount, deviations of the conveyance and the moving speed, and various errors that are assumed.

$$ts2=tp2-Z \quad \text{[Formula 6]}$$

The second movement speed Vs2 is calculated using the formulas 2, 3, 4, and 6. The time period ts1 that is found by the formula 3 is substituted to the formula 4 to find the time period ts2. Then, the time period ts2 and the time period tp2 that is found by the formula 2 are substituted to the formula 6 to find the second movement speed Vs2. This process will be described with reference to a flowchart shown in FIG. 8.

First, the finisher control unit 501 of the sheet processing apparatus 500 communicates with the CPU circuit unit 150 of the image forming apparatus 300, and obtains sheet size information about a sheet conveyed to the sheet processing apparatus 500 (step S101). Then, the finisher control unit 501 determines a length Ls of the sheet, which is subjected for detecting the side end, in the sheet conveyance direction based on the sheet size information obtained (step S102). Although the sheet size information shows standards, such as an A4 size, a B4 size, and an A5 size, for example, it may be another format as long as the sheet length Ls can be determined.

It should be noted that a system by which the finisher control unit 501 can determine the sheet length Ls without using the sheet size information may be mounted. For example, a mechanism that measures the sheet length in the sheet conveyance direction at the time when a sheet enters or before may be provided. In such a case, the finisher control unit 501 obtains the sheet length Ls from the measurement result.

Next, the finisher control unit 501 moves the sensor unit 1105 to the home position (step S103). Then, the finisher control unit 501 waits for the entrance sensor 531 to turn ON (step S104). When the entrance sensor 531 turns ON, the finisher control unit 501 determines whether the sheet has been conveyed for the time period T1 from that timing (step S105). As a result of the determination in the step S105, when it is determined that the sheet has been conveyed for the time period T1 from the timing at which the entrance sensor 531 turns ON, the finisher control unit 501 starts moving the sensor unit 1105 towards the center of the sheet in the sheet width direction (step S106).

Next, the finisher control unit 501 determines whether the side end of the sheet has been detected first, or whether the lateral position sensor 1104*a* that is the first sensor turned ON (step S107). When the lateral position sensor 1104*a* turned ON, the finisher control unit 501 calculates the value Vs2 using the formulas 2, 3, 4, and 6 according to the method mentioned above (step S108). That is, the finisher control unit 501 calculates the value Vs2 so that the value ts2 is close to the value tp2 as much as possible while satisfying the condition "ts2<tp2", and sets it up as the second movement speed Vs2.

Next, the finisher control unit 501 controls the sensor unit 1105 to move at the second movement speed Vs2 (step S109). Accordingly, as shown in FIG. 9, the movement speed of the target sensor unit 1105 switches to Vs2 from Vs1 at the timing at which the side end of the sheet is detected first (the time period ts1 elapses from the reference timing).

Next, the finisher control unit 501 determines whether the side end of the sheet has been detected secondly, or whether the second sensor (the lateral position sensor 1104*b*) turned ON (step S110). Then, when the lateral position sensor 1104*b* turned ON, the finisher control unit 501 changes the movement speed of the target sensor unit 1105 to 0, and controls the movement of the sensor unit 1105 to stop (step S111). Then, the process in FIG. 8 finishes.

Figure 8:
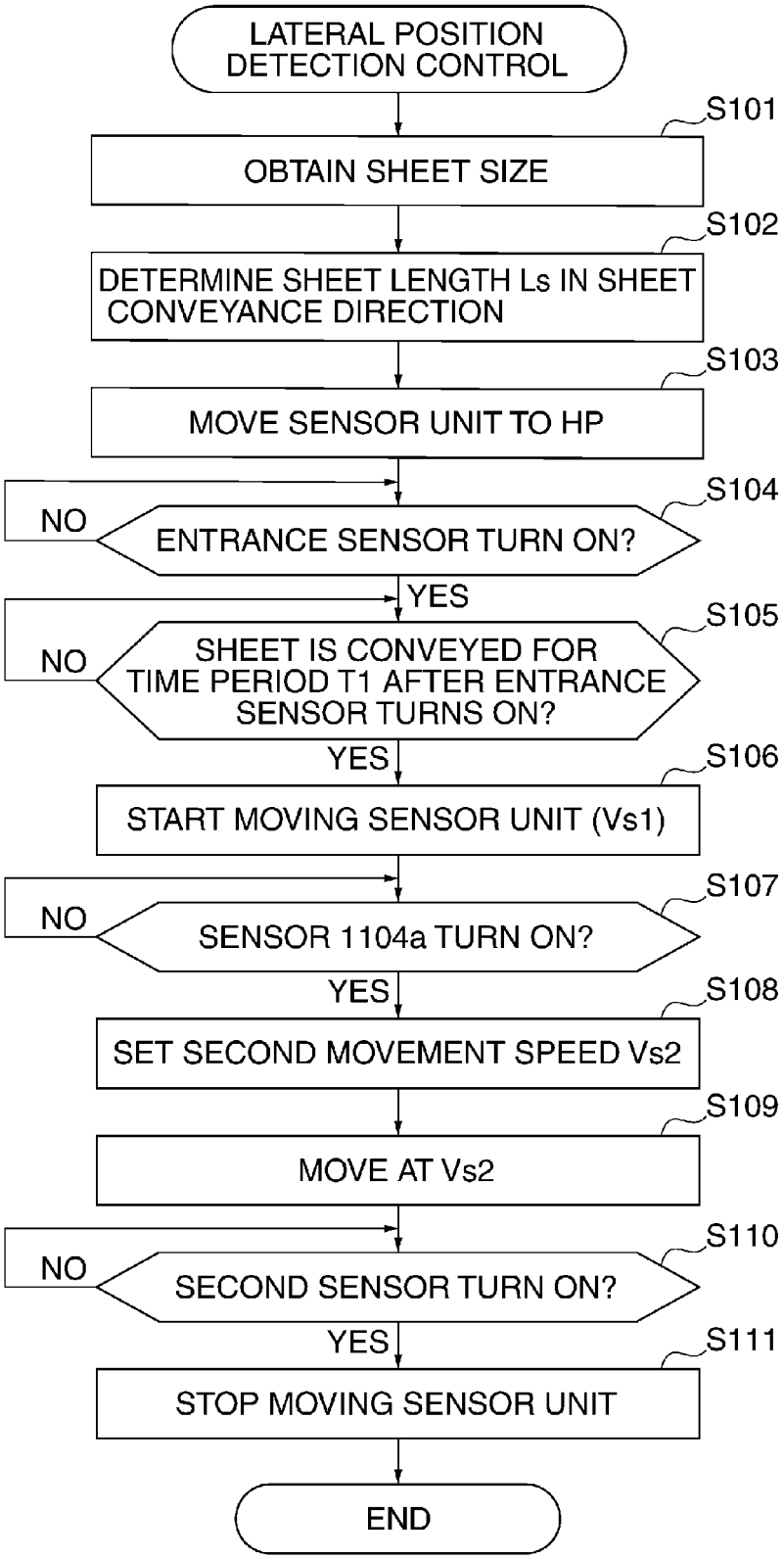
FIG. 8 is a flowchart showing a lateral position detection process executed by the sheet processing apparatus shown in FIG. 1.

After finishing the process in FIG. 8, the finisher control unit 501 stops the conveyance motor M1103 temporally, and then, controls the conveyance motor M1103 to reverse so that the sheet impinges against a stopper (not shown) in order to correct skew of the rear end of the sheet. Next, the finisher control unit 501 makes the punching unit 750 perform a punching operation in the state where the sheet impinges against the stopper. When the punching operation is completed, the finisher control unit 501 starts the conveyance motor M1103, and resumes the conveyance of the sheet.

Since the conveyance distances Y1, Y2, and the misalignment value Xd become known at the timing at which the lateral position sensor 1104*b* turns ON, the finisher control unit 501 calculates the skew amount $\alpha$ by applying these values to the formula 5.

Moreover, when making the punching unit 750 perform a punching operation, the finisher control unit 501 calculates the lateral misalignment amount taking the skew amount $\alpha$ into consideration. This lateral misalignment amount J is calculated as an misalignment amount with respect to the specified lateral position (the reference position 703 shown in FIG. 7) near the rear end of the sheet (the position in the conveyance direction where the side end is detected secondly). As shown in FIG. 7, the lateral misalignment amount J is a distance from the reference position 703 to the detection position 704 by the second sensor. A distance from the standby position of the sensor unit 1105 to the reference position 703 in the sheet width direction is set to C. The lateral misalignment amount J is calculated by the formula: $J=C-(X1+X2+\alpha\cdot f)$ in a case of near side advanced skew, and is calculated by the formula: $J=C-(X1+X2-\alpha\cdot f)$ in a case of back side advanced skew. Here, the near side advanced skew means a state where the sheet is skewed so that the near side advances rather than the back side as illustrated in FIG. 7. The back side advanced skew means a state where the sheet is skewed so that the back side advances rather than the near side.

Then, after the sheet rear end exits from the conveying roller pair 503, the finisher control unit 501 executes a lateral misalignment correction based on the lateral misalignment amount. That is, the finisher control unit 501 moves the lateral position shift unit 1001 in the sheet width direction so as to cancel the lateral misalignment. After canceling the lateral misalignment, the punching unit 750 performs the punching process. Accordingly, high position accuracy of the hole formed by the punching unit 750 is maintained.

In this embodiment, a sheet (or the lateral position shift unit 1001) is shifted to align punch hole positions based on the calculation result of the lateral misalignment amount J during the lateral misalignment correction. However, a method of the lateral misalignment correction is not limited to this method. That is, another method for shifting at least one of the lateral position shift unit 1001 and the punching unit 750 may be employed.

Figure 10:
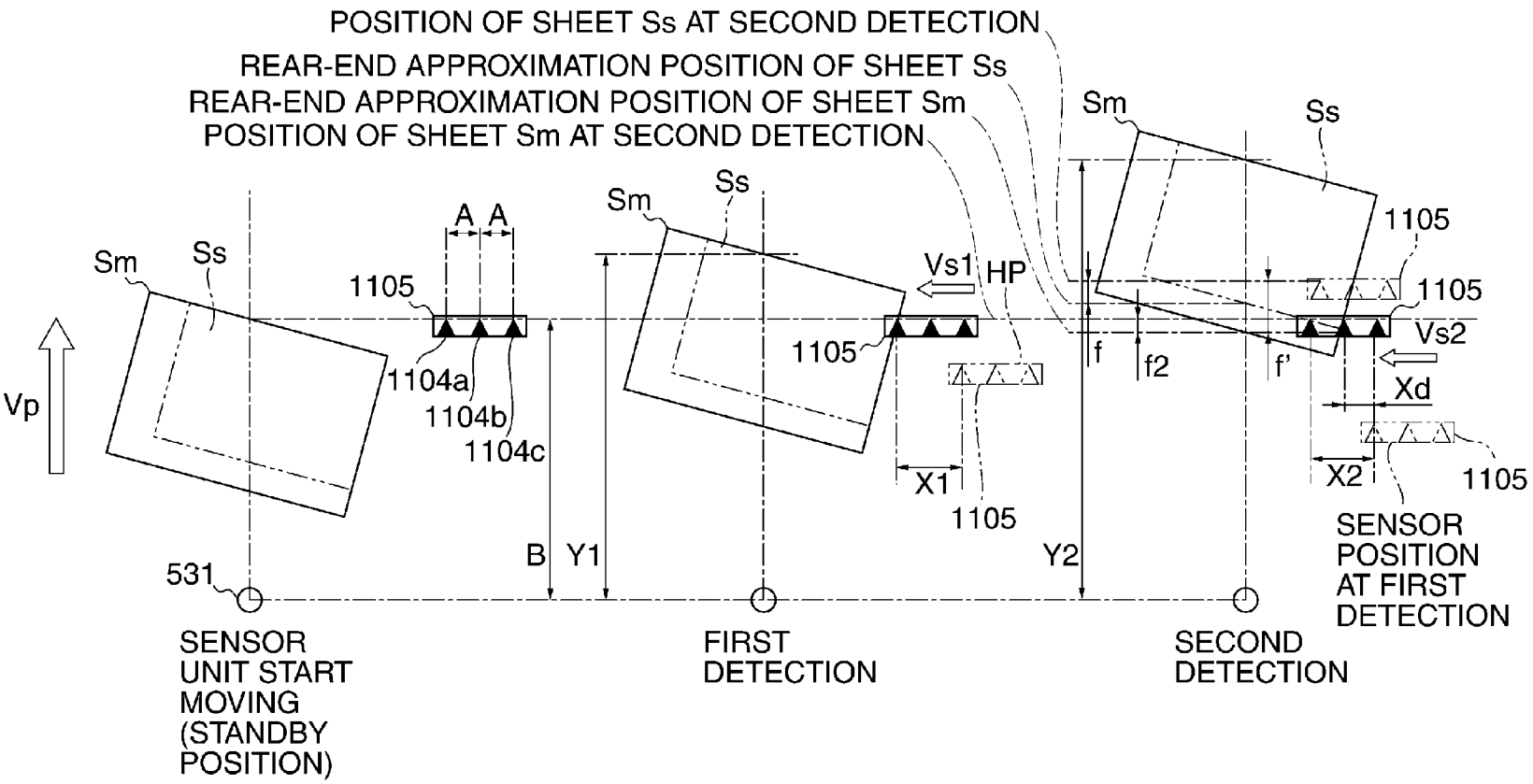
FIG. 10 is a view showing a state where the sensor unit shown in FIG. 4 detects a side end of a sheet that is larger than the sheet in FIG. 7 twice.

Here, a case where sheets of different sizes are processed will be described with reference to FIG. 10. FIG. 10 is a view showing a state where the sensor unit 1105 detects a side end of a sheet twice. FIG. 10 shows sheets of two sheet sizes for comparison. That is, the sheet size of the sheet Sm is larger than the sheet size of the sheet Ss, and the sheet length Ls of the sheet Sm is longer than the sheet length of the sheet Ss.

About the sheet Sm that is subjected for detecting the side end, the sheet length Ls determined in the step S102 in FIG. 8 is longer than that of the sheet Ss. A distance from a position at which the side end is detected secondly to a sheet-rear-end approximation position in the sheet conveyance direction is determined as f2 shown in FIG. 10 through the process in FIG. 8. If the process in FIG. 8 is proceeded in a state where the sheet length of the sheet Ss still remains as the determined sheet length Ls, the above-mentioned distance will become f' as shown in FIG. 10, it is too long. On the other hand, in the embodiment, since the second detection timing varies according to the size of the conveyed sheet, the above-mentioned distance is set to f2, and will be greatly shortened as compared with f'.

According to the embodiment, the second movement speed Vs2 is calculated and set based on the sheet length Ls, the sensor arrangement interval A, the sheet conveyance speed Vp, the first movement speed Vs1, and the moving distance X1. Accordingly, the sheet conveyance distance from the first detection to the second detection can be set according to the sheet length Ls when detecting the sheet end in the width direction with two sensors. Specifically, the sheet conveyance distance from the first detection to the second detection was set as long a distance as possible. Since this enlarges the misalignment value Xd and the difference (Y2−Y1) in the formula 5 for calculating the skew amount α as much as possible, the calculation accuracy of the skew amount α is improved. As a result, the accuracy of the lateral misalignment correction and the accuracy of hole positions on a sheet are improved.

It should be noted that the second movement speed Vs2 may be set based on only the sheet length Ls in the embodiment from a viewpoint of simplifying the configuration. Since the sheet sizes of the sheets used are assumed by the standard, the sheet length Ls can be assumed to some extent. Accordingly, the second movement speeds Vs2 are stored beforehand in associated with the sheet lengths Ls so that the lateral position sensor 1104*b* certainly reaches the side end of a sheet before the sheet rear end exits from the position of the lateral position sensors 1104*a*, 1104*b*, and 1104*c*. In that case, the values stored have margins in consideration of deviation of the moving distance X1 that is a variable element and various kinds of variations. Then, the finisher control unit 501 sets up the value Vs2 corresponding to the determined sheet length Ls as the second movement speed Vs2.

It should be noted that the second movement speed Vs2 is preferably lower than the first movement speed Vs1 (Vs2<Vs1). Then, the side end is certainly detected secondly, and the time interval until the side end is detected first from the movement start of the sensor unit 1105 can be shortened, which improves productivity.

Moreover, the second sensor is distant from the center in the sheet width direction as compared with the first sensor. Accordingly, a combination of the lateral position sensors 1104*a* and 1104*c* or a combination of the lateral position sensors 1104*b* and 1104*c* is employable as the combination of the first and second sensors in addition to the combination of the lateral position sensors 1104*a* and 1104*b*. In the first embodiment, since certain two sensors are used, it is not indispensable to have three or more sensors.

Next, a second embodiment of the present invention will be described. In the first embodiment, the second movement speed Vs2 is set up according to the sheet length Ls. On the other hand, in the second embodiment, a sensor used for detecting a side end secondly is selected according to the sheet length Ls, and then, the second movement speed Vs2 is set up according to the sheet length Ls as with the first embodiment.

Figure 11:
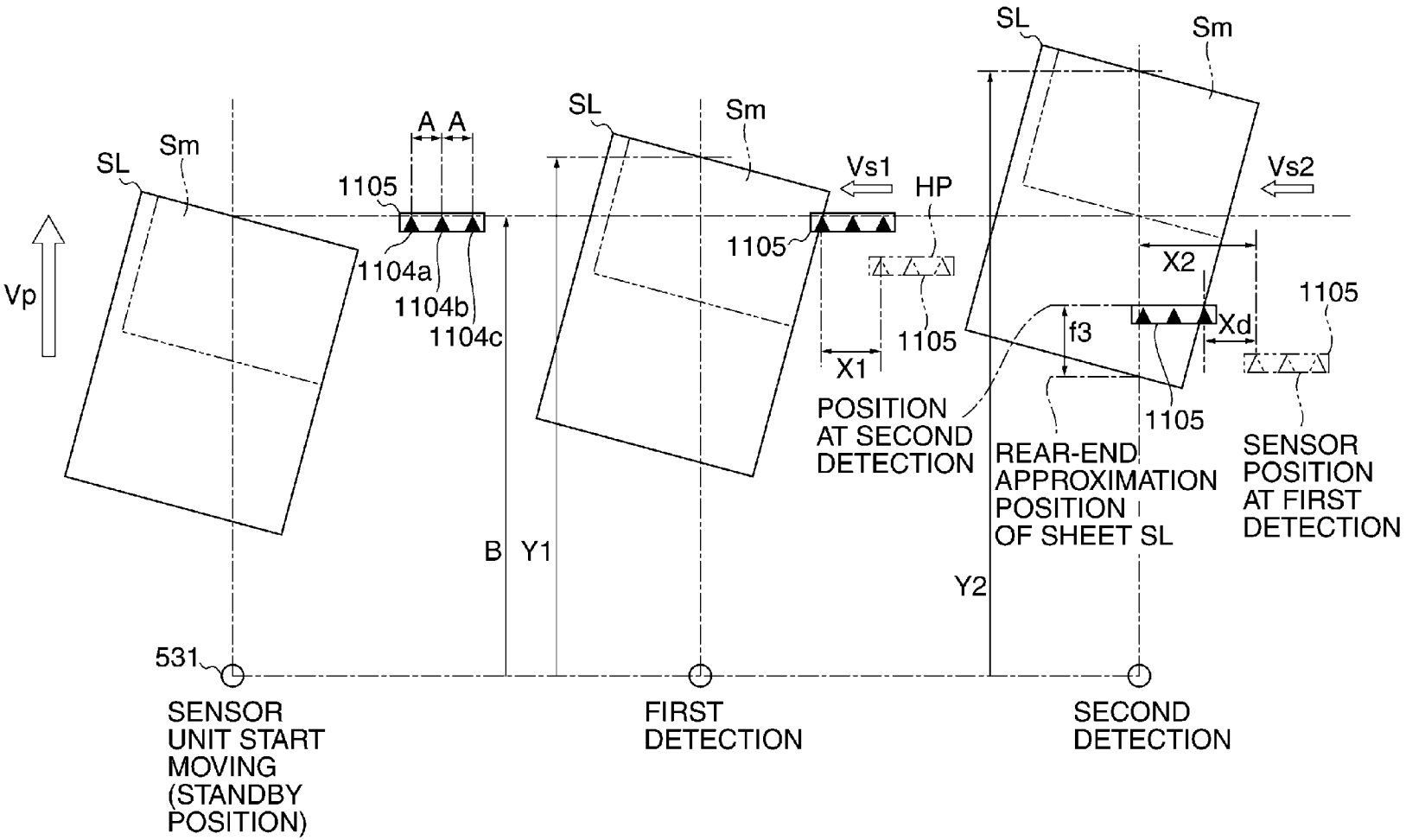
FIG. 11 is a view showing a state where a sensor unit in a second embodiment detects a side end of a sheet twice.
Figure 12:
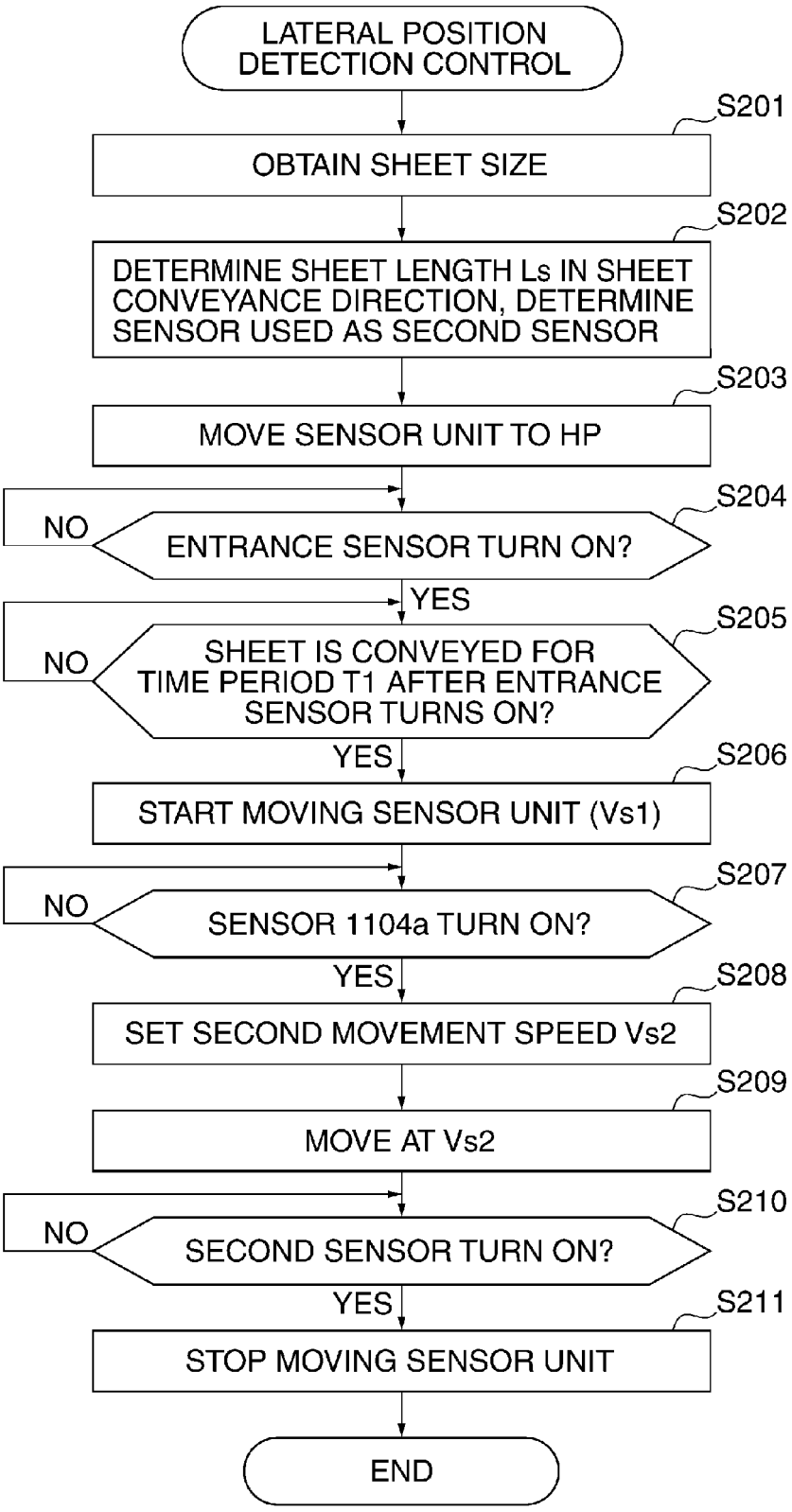
FIG. 12 is a flowchart showing a lateral position detection control in the second embodiment.
Figure 13:
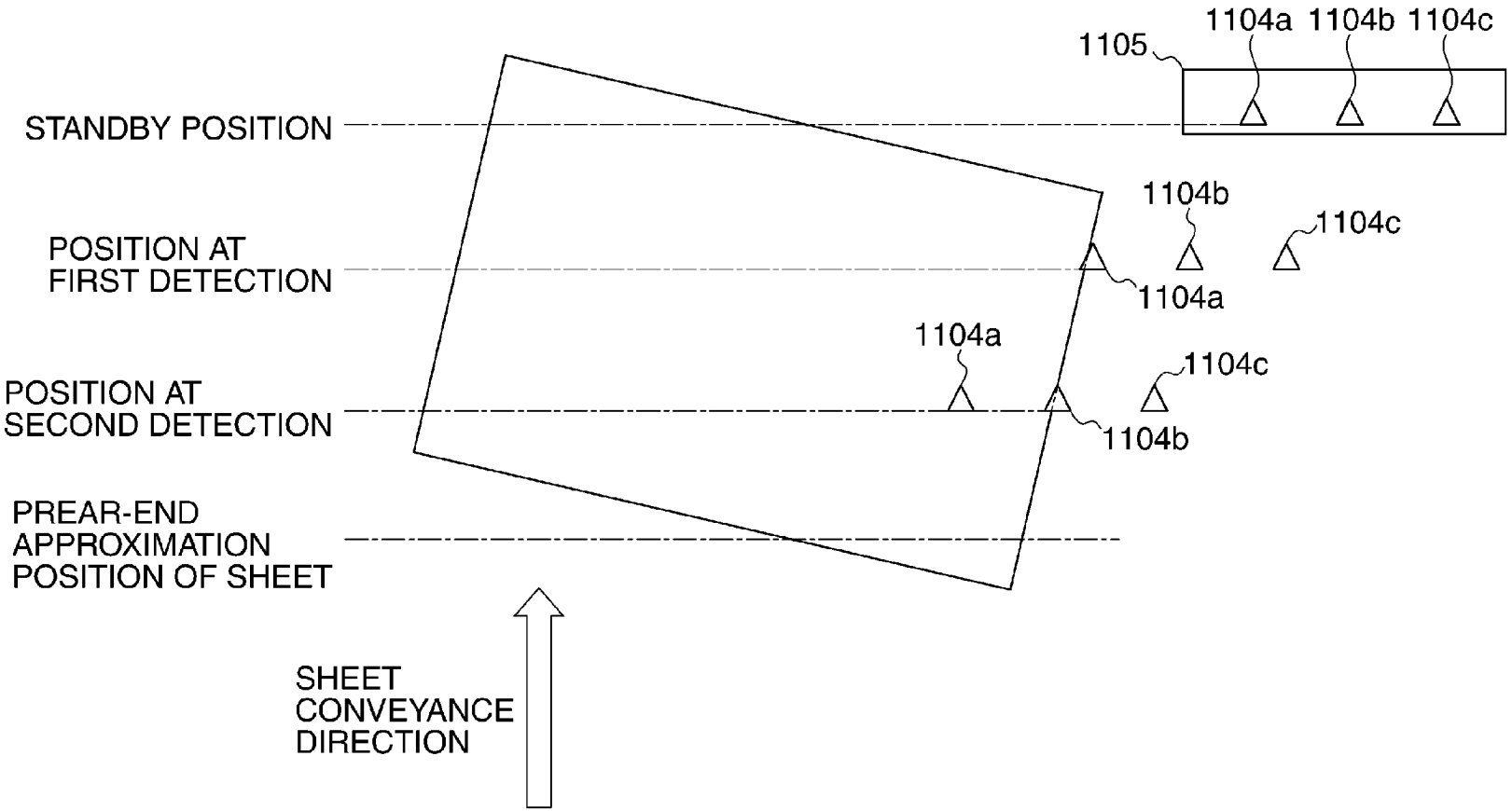
FIG.13 PRIOR ART
FIG. 13 is a view showing a state where a conventional sheet processing apparatus detects a sheet side end.

FIG. 11 is a view showing a state where the sensor unit 1105 in the second embodiment detects a side end of a sheet twice. FIG. 12 is a flowchart showing a lateral position detection control in the second embodiment.

The lateral position detection control will be described along with FIG. 12. In the embodiment, it is assumed that the lateral position sensor 1104*a* is determined as a first sensor beforehand.

First, the finisher control unit 501 obtains sheet size information in step S201 like the step S101 in FIG. 8. Then, the finisher control unit 501 determines the length Ls of the sheet, which is subjected for detecting the side end, in the sheet conveyance direction based on the sheet size information obtained in step S102. At the same time, a sensor that will be used as a second sensor is selected from among the sensors (the lateral position sensors 1104*b* and 1104*c*) other than the first sensor corresponding to the sheet length Ls, and it is determined.

Here, a sensor corresponding to the sheet length Ls is selected using a threshold. For example, when the sheet length Ls is shorter than the threshold, the lateral position sensor 1104*b* is selected, and when it is longer than the threshold, the lateral position sensor 1104*c* is selected. When the number of lateral position sensors is four or more, the number of thresholds should increase accordingly.

In the following steps S203 through S211, the finisher control unit 501 executes the same process as in the steps S103 through S111 in FIG. 8. Although the lateral position sensor 1104*b* is always applied to the process concerning the second sensor in the first embodiment, a sensor selected as the second sensor is applied in the second embodiment.

For example, the finisher control unit 501 determines whether the side end of a sheet has been detected secondly, or whether the second sensor (what is selected from among the lateral position sensor 1104*b* and 1104*c*) turned ON in the step S210.

Moreover, since the lateral position sensors 1104*a*, 1104*b*, and 1104*c* are arranged at equal intervals A, the misalignment value Xd is obtained by the formula Xd=X2−A, using the moving distance X2 in the same manner as the first embodiment when the lateral position sensor 1104*b* is selected as the second sensor (see FIG. 7). When skew of a sheet is zero, Xd2 is equal to A because Xd is 0. On the other hand, when the lateral position sensor 1104*c* is selected as the second sensor, the misalignment value Xd is obtained by the formula Xd=X2−2A as shown in FIG. 11. When skew of a sheet is zero, X2 is equal to 2A because Xd is 0.

The moving distance X2 varies in stages depending on the selected sensor. Accordingly, the second movement speed Vs2 can be set up using the formulas 2, 3, 4, and 6 like the first embodiment by reflecting the arrangement interval (A or 2A) of the first sensor and the second sensor to the calculation.

As shown in FIG. 11, even when the sheet SL with a larger sheet size than the sheet Sm is subjected for detecting a side end, a distance from a position at which the side end is detected secondly to a rear-end approximation position of the sheet SL in the sheet conveyance direction is determined as f3 through the process in FIG. 12. The distance f3 is a value short enough.

According to the second embodiment, since the sheet conveyance distance from the first detection to the second detection is set up according to the sheet length when detecting a sheet end in the width direction with two sensors, the same effect as the first embodiment can be obtained. Particularly, since the second movement speed Vs2 is set up after selecting the optimal second sensor, it can respond to sheet sizes in a wider range.

It should be noted that only sensor selection may be employed in the second embodiment. In such a case, a lateral position sensor that will be used as the second sensor is selected according to the sheet length Ls in the step S202 in FIG. 12 from a viewpoint of simplifying the configuration. Then, the second movement speed Vs2 is not calculated, and the sensor unit 1105 moves uniformly at the first movement speed Vs1. Even in such a configuration, it obtains the effect in that the sheet conveyance distance from the first detection to the second detection becomes longer as compared with the conventional configuration that employs a uniform sensor that moves in a uniform movement speed.

Alternatively, a lateral position sensor that will be used as the second sensor may be selected based on the sheet length Ls, the arrangement intervals of the lateral position sensors 1104*a*, 1104*b*, and 1104*c*, the sheet conveyance speed Vp, the first movement speed Vs1, and the moving distance X1. Also in such a case, the second movement speed Vs2 is not calculated, and the sensor unit 1105 moves uniformly at the first movement speed Vs1. In this configuration, the three or more lateral position sensors are indispensable, and four or more sensors are desirable. This configuration is achieved as follows using the formulas 2, 3, 7, and 8.

First, the following formula 7 is used in place of the formula 4.

$$ts2=ts1+n\cdot A/Vs1 \quad \text{[Formula 7]}$$

Here, since Vs2 is equal to Vs1, Vs1 is substituted in place of Vs2. The value "n" specifies a sensor among the lateral position sensors. The first sensor is represented by "n=0". The lateral position sensor 1104*b* corresponds to "n=1", and the lateral position sensor 1104*c* corresponds to "n=2". Accordingly, the product "n·A" represents an arrangement interval between the first sensor and the second sensor.

Moreover, the following formula 8 is used in place of the formula 6.

$$ts2\leq tp2-Z \quad \text{[Formula 8]}$$

Where "Z" is a margin value. Then, the largest value n is calculated as long as the formula 8 is satisfied using the formulas 2, 3, and 7. For example, when "n=1" is set, the lateral position sensor 1104*b* will be selected, and when "n=2" is set, the lateral position sensor 1104*c* will be selected. Accordingly, the sensor arranged at the farthest position from the first sensor as long as the condition "ts2<tp2" is satisfied is selected as the second sensor.

It should be noted that the lateral position sensors 1104*a*, 1104*b*, and 1104*c* do not necessarily need to be arranged at equal intervals in the above-mentioned embodiments. It is enough that an arrangement interval (distance) with respect to the first sensor is known. What is necessary is to apply the known value to each the above-mentioned formulas in place of the interval A.

It should be noted that the first sensor does not necessarily need to be the lateral position sensor 1104*a* that is nearest to the center position of the sheet in the width direction. What is necessary is the configuration that the lateral position sensor that can be used as the second sensor exists in the position away from the center position in the sheet width direction to the first sensor.

Although the embodiments of the invention have been described, the present invention is not limited to the above-mentioned embodiments, the present invention includes various modifications as long as the concept of the invention is not deviated. Parts of the above-mentioned embodiments may be combined suitably.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-160375, filed Aug. 1, 2013, which is hereby incorporated by reference herein in its entirety.

What is claimed is:

1. A sheet processing apparatus comprising:

a conveyance unit configured to convey a sheet;

a sensor unit configured to have a plurality of sensors that are arranged in a sheet width direction that intersects perpendicularly with a sheet conveyance direction, and that detect a side end of a sheet in the sheet width direction;

a moving unit configured to move said sensor unit in the sheet width direction;

a control unit configured to control said moving unit so as to move said sensor unit at a first movement speed during conveyance of the sheet by said conveyance unit, and so as to move said sensor unit at a second movement speed after the side end of the sheet is detected by a first sensor among the plurality of sensors so that the side end of the sheet is detected by a second sensor among the plurality of sensors;

an obtaining unit configured to obtain a sheet length of the sheet in the sheet conveyance direction; and a setting unit configured to set up the second movement speed based on the sheet length obtained by said obtaining unit, wherein said control unit controls said moving unit so as to move said sensor unit at the second movement speed set up by said setting unit until the side end of the sheet is detected by the second sensor after the side end of the sheet is detected by the first sensor.

2. The sheet processing apparatus according to claim 1, wherein said setting unit sets up the second movement speed based on the sheet length obtained by said obtaining unit, an arrangement interval between the first sensor and the second sensor, a conveyance speed of the conveyed sheet by said conveyance unit, the first movement speed, and the position of the side end of the sheet detected by the first sensor, when the side end of the sheet is detected by the first sensor.

3. The sheet processing apparatus according to claim 1, wherein said setting unit sets up the second movement speed so that the second sensor detects the side end of the sheet before a rear end of the sheet exits from the position of the second sensor in the sheet conveyance direction.

4. The sheet processing apparatus according to claim 1, wherein the second movement speed is set so as to be lower than the first movement speed.

5. A sheet processing apparatus comprising:

a conveyance unit configured to convey a sheet;

a sensor unit configured to have three or more sensors that are arranged in a sheet width direction that intersects perpendicularly with a sheet conveyance direction, and that detect a side end of a sheet in the sheet width direction;

a moving unit configured to move said sensor unit in the sheet width direction;

a control unit configured to control said moving unit so as to move said sensor unit during conveyance of the sheet by said conveyance unit so that the side end of the sheet is detected by a first sensor among the plurality of sensors and then the side end of the sheet is detected by a second sensor selected from among the plurality of sensors;

an obtaining unit configured to obtain a sheet length of the sheet in the sheet conveyance direction; and a selection unit configured to select a sensor that will be used as the second sensor from among the plurality of sensors other than the first sensor corresponding to the sheet length obtained by said obtaining unit.

6. The sheet processing apparatus according to claim 5, wherein said selection unit selects the second sensor based on the sheet length obtained by said obtaining unit, the arrangement intervals the plurality of sensors to the first sensor, a conveyance speed of the sheet conveyed by said conveyance unit, the movement speed of said sensor unit, and the position of the side end of the sheet detected by the first sensor.

7. The sheet processing apparatus according to claim 5, wherein said selection unit selects a sensor arranged at the farthest position from the first sensor as the second sensor as long as the condition where the second sensor detects the side end of the sheet before a rear end of the sheet exits from the position of the second sensor in the sheet conveyance direction is satisfied.

8. The sheet processing apparatus according to claim 5, further comprising:

a setting unit configured to set up a second movement speed based on the sheet length obtained by said obtaining unit, an arrangement interval between the first sensor and the second sensor, a conveyance speed of the sheet by said conveyance unit, a predetermined first movement speed, and the position of the side end of the sheet detected by the first sensor, wherein said a control unit configured to control said moving unit so as to move said sensor unit at the first movement speed during conveyance of the sheet by said conveyance unit, and so as to move said sensor unit at the second movement speed set up by said setting unit until the side end of the sheet is detected by the second sensor after the side end of the sheet is detected by the first sensor.

9. The image processing apparatus according to claim 8, wherein said setting unit sets up the second movement speed so that the second sensor detects the side end of the sheet before a rear end of the sheet exits from the position of the second sensor in the sheet conveyance direction.

10. The sheet processing apparatus according to claim 8, wherein the second movement speed is set so as to be lower than the first movement speed.

11. The sheet processing apparatus according to claim 1, further comprising:

a first calculation unit configured to calculate a skew amount of the sheet based on the arrangement interval between the first sensor and the second sensor, the moving amount of the second sensor until the side end of the sheet is detected by the second sensor after the side end of the sheet is detected by the first sensor, and a conveyance amount of the sheet until the side end of the sheet is detected by the second sensor after the side end of the sheet is detected by the first sensor.

12. The sheet processing apparatus according to claim 11, further comprising:

a second calculation unit configured to calculate a lateral misalignment amount of the sheet with respect to a specified lateral position based on the skew amount calculated by said first calculation unit, the detection result of the first sensor, and the detection result of the second sensor.

13. The sheet processing apparatus according to claim 12, further comprising:

a shift unit configured to shift said conveyance unit in the sheet width direction based on the lateral misalignment amount calculated by said second computation unit.

14. The sheet processing apparatus according to claim 13, further comprising:

a punching unit configured to form a punch hole to the sheet after said shift unit shifts said conveyance unit based on the lateral misalignment amount.

15. The sheet processing apparatus according to claim 12, further comprising:

a punching unit configured to form a punch hole to the sheet; and a shift unit configured to shift said conveyance unit in the sheet width direction based on the lateral misalignment amount calculated by said second computation unit before a punch hole is formed by said punching unit.

* * * * *